US009033462B2

(12) United States Patent
Komaki

(10) Patent No.: US 9,033,462 B2
(45) Date of Patent: May 19, 2015

(54) WASTE INK TANK AND INKJET PRINTER

(71) Applicant: SEIKO EPSON CORPORATION, Tokyo (JP)

(72) Inventor: Takeshi Komaki, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/101,349

(22) Filed: Dec. 10, 2013

(65) Prior Publication Data

US 2014/0176643 A1 Jun. 26, 2014

(30) Foreign Application Priority Data

Dec. 26, 2012 (JP) ..... 2012-282216

(51) Int. Cl.
*B41J 2/165* (2006.01)
*B41J 2/17* (2006.01)

(52) U.S. Cl.
CPC ..... *B41J 2/1721* (2013.01); *B41J 2002/1728* (2013.01)

(58) Field of Classification Search
CPC ..... B41J 2/1721
USPC ..... 347/36
See application file for complete search history.

(56) References Cited

U.S. PATENT DOCUMENTS

2009/0219338 A1* 9/2009 Harada ..... 347/36
2010/0123756 A1 5/2010 Yamada et al.
2013/0027482 A1 1/2013 Yamada et al.

FOREIGN PATENT DOCUMENTS

JP 2010115911 A 5/2010
JP 2010137550 A 6/2010
JP 2010214920 A 9/2010

* cited by examiner

*Primary Examiner* — Jason Uhlenhake
(74) *Attorney, Agent, or Firm* — Lowe Hauptman & Ham, LLP

(57) ABSTRACT

The case 22 of a waste ink tank 13 has ribs 51, 52 that partition the space between a waste ink inlet 36 and an air vent 33. Air passages 65, 66 that connect the waste ink storage spaces S1, S2, S3 partitioned by the ribs are formed at the top ends of the ribs 51, 52. Waste ink permeates all of a sponge 21 through the space between the ribs 51, 52 and the bottom wall 24. Because a path for air to flow to the air vent 33 is constantly maintained inside the case 22 by the air passages 65, 66, air is discharged from the air vent 33 as waste ink is introduced to the case 22. The strength of the case can therefore be increased without interfering with introducing waste ink to the case and absorption of introduced waste ink by the sponge.

10 Claims, 5 Drawing Sheets

WASTE INK TANK AND INKJET PRINTER

RELATED APPLICATIONS

The present application is based on, and claims priority from, Japanese Application Number 2012-282216, filed Dec. 26, 2012, the disclosure of which is hereby incorporated by reference herein in their entirety.

BACKGROUND

1. Technical Field

The present disclosure relates to a waste ink tank that stores the waste ink ejected from an inkjet head when flushing the inkjet head, and to an inkjet printer that uses the waste ink tank.

2. Related Art

Inkjet printers regularly execute a flushing operation to prevent the ink nozzles from becoming clogged due to the ink increasing in viscosity. The inkjet head is set to a maintenance position opposite a head cap, and ink droplets are then ejected from the inkjet head into the head cap during the flushing operation. The ink ejected into the head cap is recovered as waste ink and stored in a waste ink tank.

JP-A-2010-137550 describes an ink cartridge that has an ink tank and a waste ink tank. The waste ink tank has a case that stores the waste ink, and the case has a waste ink inlet through which waste ink stored in the head cap is input to the case, and a vent from which air is removed from the case when waste ink is input. The case is thin and flat to minimize the space occupied by the waste ink tank when the ink cartridge is installed in the inkjet printer.

Some waste ink tanks have a sponge inside the case to absorb the waste ink. The size of the sponge must be increased in such waste ink tanks in order to absorb a sufficient volume of waste ink. However, because the waste ink tank is typically thin as described in JP-A-2010-137550, the strength of the case can be weakened as a result of increasing the size of the sponge.

Ribs could be disposed inside the case to improve the strength of the case. If ribs are provided, however, the ribs must not interfere with penetration of the waste ink to the sponge. Furthermore, because waste ink will spill from the waste ink inlet if air inside the case is not appropriately discharged from the air vent so that the air is steadily replaced by the waste ink, the ribs must also not block the air path to the air vent inside the case.

SUMMARY

A waste ink tank according to the disclosure improves the strength of the case of the waste ink tank without interfering with inputting waste ink to the case or absorption of the input waste ink by the sponge. An inkjet printer according to the disclosure uses this waste ink tank.

A waste ink tank according to a preferred aspect of the disclosure includes a case having a waste ink inlet and an air vent that are disposed at the top part of the case; a waste ink storage space that stores waste ink introduced to the case from the waste ink inlet; an absorbent sponge that absorbs the waste ink inside the case; a rib that partitions the waste ink storage space inside the case; and an air passage formed at the top part of the rib and connecting the plural waste ink storage spaces that are separated by the rib.

This aspect of the disclosure improves the strength of the case by providing a rib extending from the ceiling panel down toward the bottom panel inside the case. Waste ink introduced from the waste ink inlet to the case permeates down through the sponge by gravity, and moves through the space between the bottom end of the rib and the bottom panel of the case to the vent hole side of the rib. The rib therefore does not interfere with the waste ink permeating all of the sponge. In addition, because a path for air to flow from the waste ink inlet to the air vent is maintained by the air passage formed at the top end of the rib, air can be discharged from the air vent at the same time waste ink is introduced to the case even if the pressure inside the case is increased by the pressure of inputting waste ink from the waste ink inlet, and air inside the case can be steadily replaced by waste ink. Waste ink will therefore not leak from the waste ink inlet.

In addition, because a rib is provided inside the case, the absorbent sponge held in the waste ink storage space near the waste ink inlet by the rib is kept wet by the waste ink input from the waste ink inlet. Permeation to the sponge is thus promoted even when the waste ink is a pigment ink.

Preferably, the case has a ceiling panel, a floor panel, a front panel that extends vertically and connects the end part on one side of the ceiling panel with the end part on the same one side of the floor panel, a back panel that is opposite the front panel and connects the end part on the other side of the ceiling panel with the end part on the other side of the floor panel, and has the waste ink inlet formed in the front panel; and the rib includes two ribs extending from the ceiling panel of the case toward the floor panel opposite the ceiling panel.

If pluralities of ribs are provided, the strength of the case can be easily improved. If the ribs connect to the ceiling panel, case strength can be assured even if an air passage is formed in the top of each rib.

Further preferably, the bottom end of the rear rib, which of the two ribs is the rib on the air vent side, is positioned lower than the bottom end of the front rib, which is the rib on the waste ink inlet side.

Thus comprised, waste ink that is input from the waste ink inlet and permeates the sponge first permeates the part of the sponge held in the waste ink storage space between the front rib and the back rib through the gap between the bottom end of the rib and the floor panel, and then permeates the part of the sponge held in the waste ink storage space between the rear rib and the back panel. The time until the waste ink permeates to near the air vent can therefore be delayed.

Further preferably, the front rib and the rear rib extend in a straight line. Because the shape of the rib is simple, the sponge can be easily held inside the case. A large waste ink storage space can also be created inside the case, and a large sponge can be stored.

Further preferably, the front panel is parallel to the back panel and perpendicular to the ceiling panel; the front rib and rear rib are both parallel to the front panel and perpendicular to the ceiling panel; and the space between the rear rib and the back panel is narrower than the space between the front panel and the front rib and the space between the front rib and the rear rib.

The waste ink tank is generally installed in an inkjet printer by holding the part on the opposite side as the front panel where the waste ink inlet is disposed (that is, a part on the side near the back panel). By narrowing the gap between the rear rib and the back panel and increasing the strength of the case at the back where the case is easy to hold, deformation of the case when installing and removing the waste ink tank can be prevented.

Further preferably, the case has a side panel covering the opening on one side of a frame formed by the ceiling panel, floor panel, front panel, and back panel, and a film covering the opening on the other side of the frame; the ceiling panel, floor panel, front panel, back panel, side panel, and rib are monolithically molded from plastic; the air passage is formed as a notch in the top end of the rib on the opposite side as the side panel; and the film is welded to the ceiling panel, floor panel, front panel, back panel, and rib.

If an opening to the frame formed by the ceiling panel, floor panel, front panel, and back panel is covered by welding a film thereto, the case can be easily made fluid tight. If the top end of the rib is notched on the opposite side as the side panel, the notched part becomes the air passage when the film is welded to the rib, and an air passage can be easily created.

Further preferably, the air vent is formed in the top part of the film on the side closer to the back panel than the front panel.

In a waste ink tank according to another aspect of the disclosure, a valve that opens only when waste ink is introduced is disposed to the air vent; the valve has a plug member that protrudes from the side panel so that the film in which the air vent is formed and the distal end of the plug member contact around the periphery of the air vent in the film and the plug member closes the air vent; and the air vent opens by the periphery of the air vent in the film deformed by the pressure of introducing waste ink from the waste ink inlet separating from the distal end of the plug member.

This aspect of the disclosure can easily render a valve that opens and closes the air vent by forming the air vent through the film and monolithically molding a post or rib, for example, as the plug member at a position on the side panel opposite the air vent. This valve opens the air vent by the edge of the air vent separating from the distal end of the plug member when the film expands due to the pressure inputting waste ink from the waste ink inlet. Additional parts are therefore not needed to provide a valve, and cost is not increased by increasing the parts count or increasing the number of parts assembly steps.

Further preferably, a protrusion is disposed to the distal end of the plug member and passes through the air vent to position the distal end to the air vent.

Further preferably, a branched support part that separates into two branches descending down to the front and back is disposed to the bottom end of the rib.

Stress on the film is thus dispersed and the parts of the film welded to the bottom ends of the rib can be prevented from tearing when a large amount of waste ink is absorbed by the sponge stored in space between the bottom end of the rib and the floor panel and the film is stretched.

Further preferably, the case is flat, and the width of the ceiling panel, floor panel, front panel, and back panel is less than the length and the height of the case. The space occupied by the waste ink tank when the waste ink tank is installed to the inkjet printer can therefore be suppressed.

Another aspect of the disclosure is an inkjet printer including: an inkjet head; a head cap that can oppose the inkjet head; the waste ink tank described above; and a waste ink recovery path that carries ink ejected from the inkjet head into the head cap to the waste ink inlet of the waste ink tank as waste ink.

Because the disclosure can improve the strength of the case of the waste ink tank, the waste ink tank can be made thin and flat. The space occupied by the waste ink tank when the waste ink tank is installed in an inkjet printer can therefore be reduced. The inkjet printer can therefore be made smaller. Furthermore, because there is no interference with inputting waste ink to the case of the waste ink tank and absorption of the input waste ink by the sponge, waste ink recovered from the head cap will not leak out from the waste ink inlet of the waste ink tank and soil the inside of the inkjet printer.

Effect of the Disclosure

The disclosure improves the strength of the case of the waste ink tank without interfering with introducing waste ink to the case or absorption of the waste ink by the sponge in the waste ink tank.

Other objects and attainments together with a fuller understanding of the disclosure will become apparent and appreciated by referring to the following description and claims taken in conjunction with the accompanying drawings.

DESCRIPTION OF EMBODIMENTS

An inkjet printer according to a preferred embodiment of the disclosure is described below with reference to the accompanying figures.

Basic Configuration

Figure 1A:
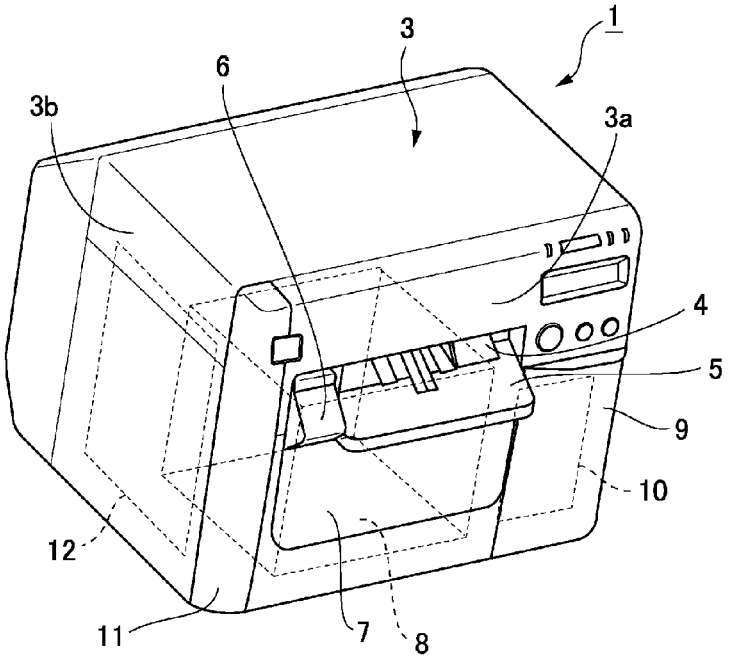
FIG. 1A is an external oblique view of an inkjet printer according to an embodiment of the disclosure.
Figure 1B:
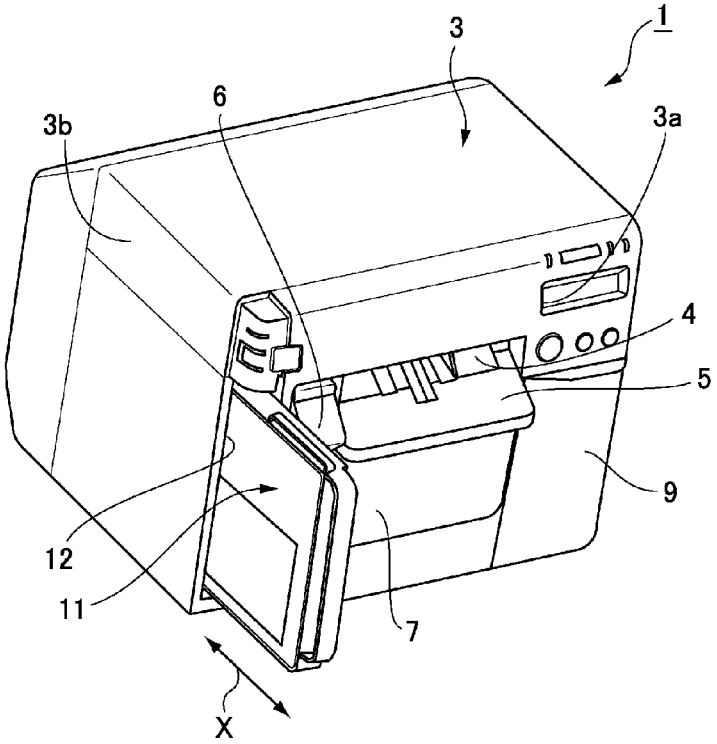
FIG. 1B is an oblique view of the inkjet printer when a waste ink tank is being removed from the printer.
Figure 2:
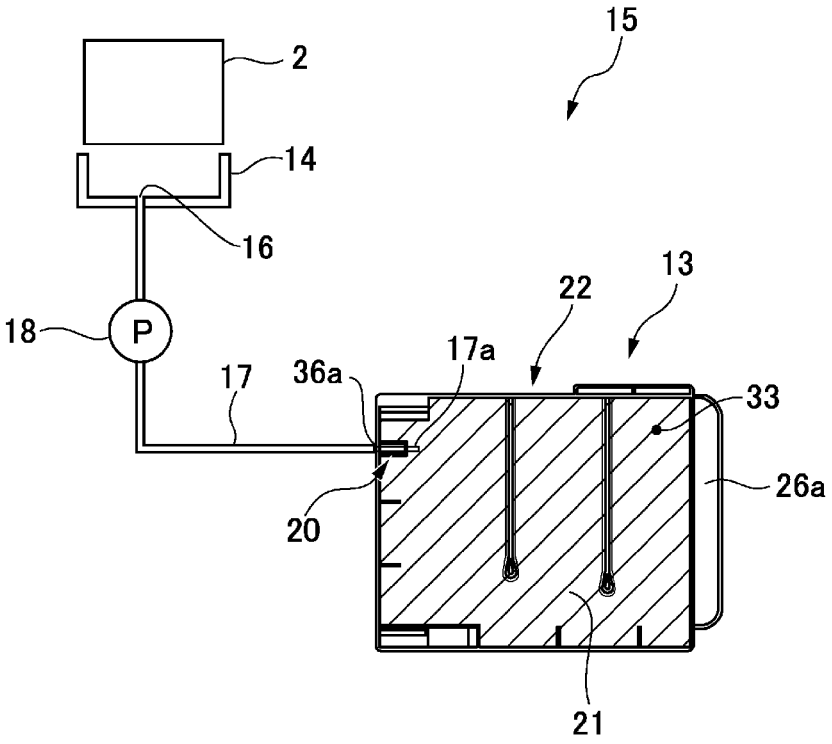
FIG. 2 describes the waste ink recovery system that recovers waste ink into a waste ink tank.

FIG. 1A is an external oblique view of an inkjet printer according to this embodiment of the disclosure, and FIG. 1B is an oblique view of the inkjet printer when the waste ink tank is being removed from the printer. A third access door is not shown in FIG. 1B. FIG. 2 describes the waste ink recovery path that recovers waste ink into the waste ink tank. The inkjet printer 1 is a roll paper printer and has a printer case 3 with an inkjet head 2 (FIG. 2).

A paper exit 4 of a specific width is disposed in the middle of the front panel 3*a* of the printer case 3. An exit guide 5 projects to the front below the paper exit 4, and an operating lever 6 is disposed beside the exit guide 5. A first access door 7 is attached below the exit guide 5 and operating lever 6. The first access door 7 is a door that opens and closes the roll paper compartment 8 provided inside the printer case 3, and operating the operating lever 6 unlocks the first access door 7. When the first access door 7 is opened, roll paper is deposited in the open roll paper compartment 8, and the first access door 7 is then closed again, the roll paper is loaded in the inkjet printer 1.

A second access door 9 is attached to the front panel 3*a* beside the first access door 7. The second access door 9 is a door that opens and closes the ink tank compartment 10. When the second access door 9 is opened and an ink tank is installed in the opened ink tank compartment 10, ink can be supplied from the ink tank to the inkjet head 2.

A third access door 11 is attached at the corner of the printer case 3 between the front panel 3*a* and side panel 3*b*. The third access door 11 is a door that opens and closes the waste ink tank compartment 12. When the third access door 11 is opened and a waste ink tank 13 is installed in the opened waste ink tank compartment 12, ink used in a flushing operation can be recovered as waste ink into the waste ink tank 13. The waste ink tank 13 is removably installable in the waste ink tank compartment 12, and when the waste ink tank 13 becomes filled with waste ink, it can be replaced with a new waste ink tank 13.

This flushing operation is an inkjet head 2 maintenance operation that is regularly performed to prevent the ink nozzles from becoming clogged due to an increase in ink viscosity. In the flushing operation, the inkjet head 2 is set to a maintenance position opposite the box-like head cap 14 as shown in FIG. 2 and ink droplets are then ejected from the inkjet head 2. The ink ejected into the head cap 14 is recovered as waste ink and stored in the waste ink tank 13.

As shown in FIG. 2, the waste ink recovery channel 15 that recovers the waste ink tank 13 includes a waste ink recovery port 16 disposed to the head cap 14, a waste ink recovery path 17 connecting the waste ink recovery port 16 to a waste ink input port 20, and a feed pump 18. When the feed pump 18 operates, waste ink collected in the head cap 14 is suctioned through the waste ink recovery port 16 and fed through the waste ink recovery path 17 to the waste ink tank 13. The waste ink recovered in the waste ink tank 13 is absorbed and held by a porous absorbent material (sponge) 21 stored in the waste ink tank 13. In this example, the sponge 21 fills the space inside the waste ink tank 13.

Waste Ink Tank

Figure 3:
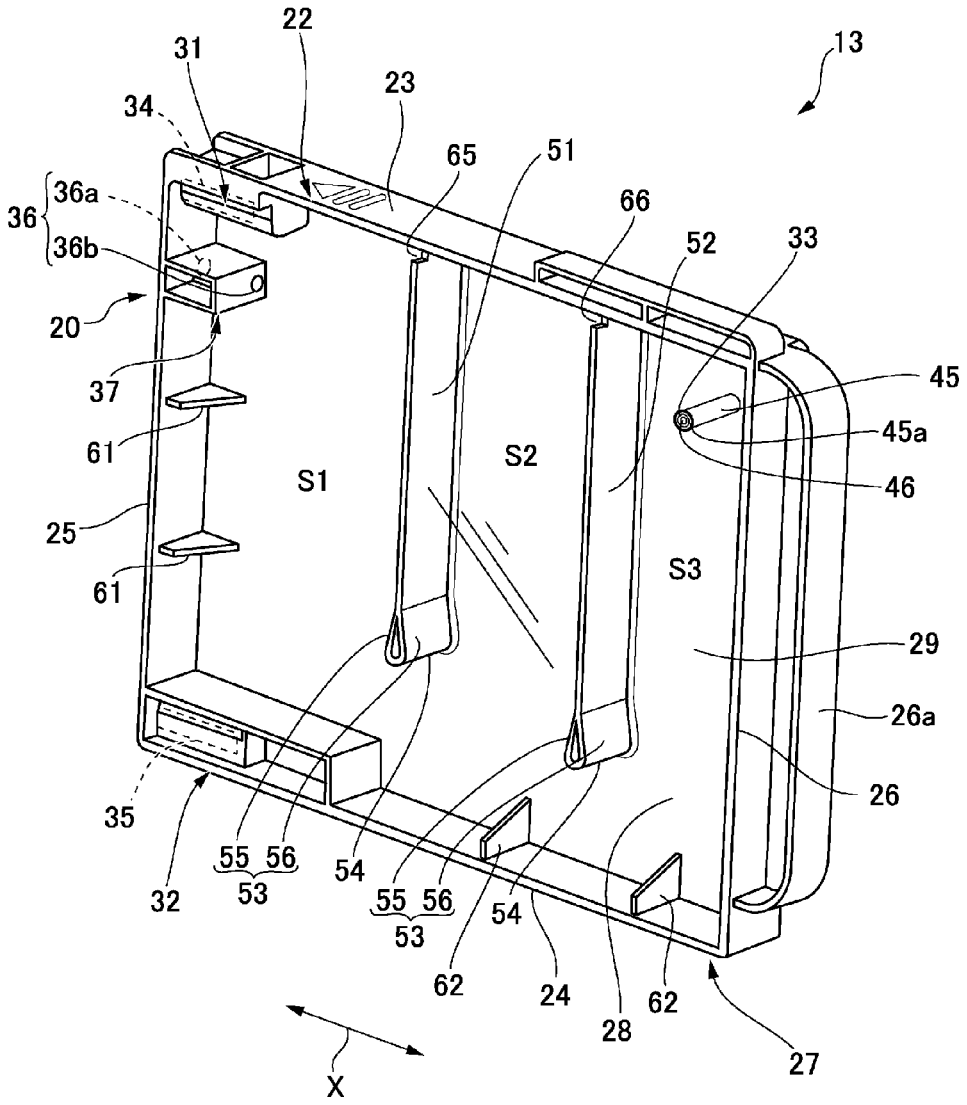
FIG. 3 is an oblique view and a side view of the waste ink tank.
Figure 4:
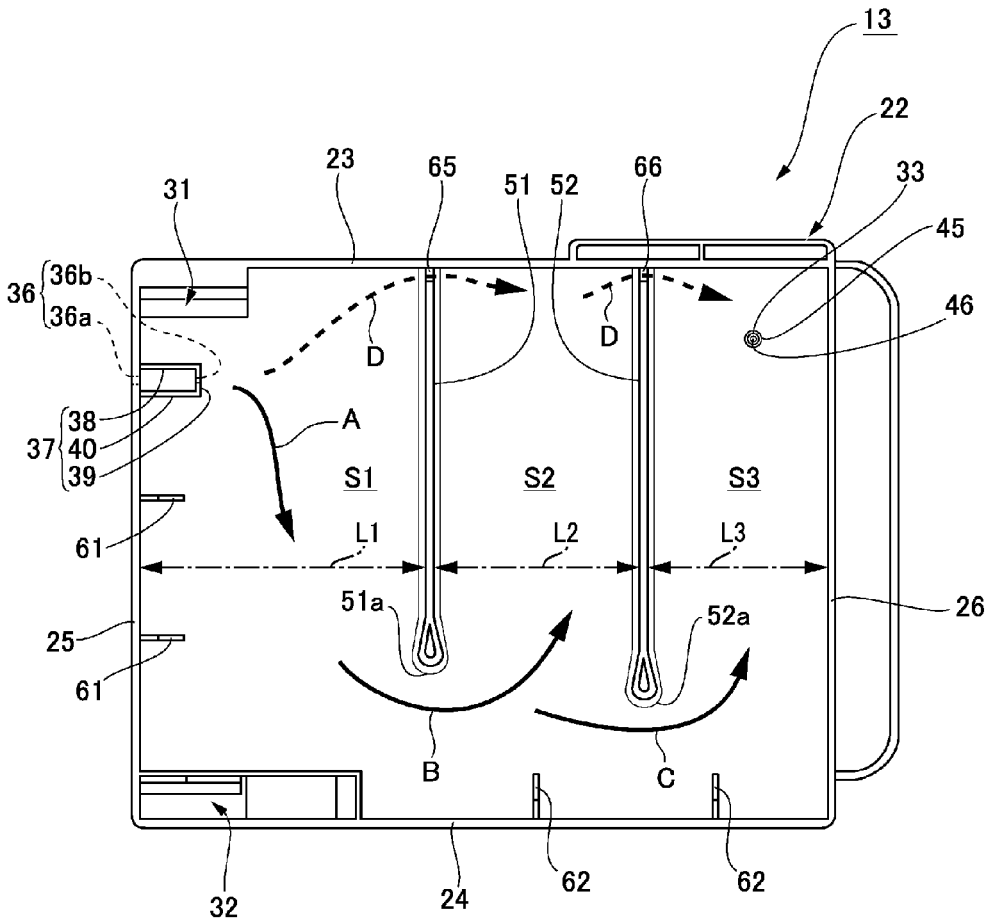
FIG. 4 describes the flow of waste ink and air inside the case.

FIG. 3 is an oblique view of the waste ink tank 13. FIG. 4 is a side view of the waste ink tank 13. The sponge 21 inside the waste ink tank 13 is not shown in FIG. 3 or FIG. 4. Note that in the following description the installation direction X (FIG. 1B) in which the waste ink tank 13 is installed to and removed from the printer case 3 is the direction between the front and back ends of the waste ink tank 13. The front end in the direction in which the waste ink tank 13 is inserted to the printer case 3 is the front end of the waste ink tank 13, and the back end in the insertion direction is the back end of the waste ink tank 13.

The waste ink tank 13 has a case 22 that stores the sponge 21 that absorbs the waste ink. The case 22 has a ceiling panel 23, a floor panel 24 vertically opposite the top 23, a front wall 25 that extends vertically and connects the front end (one end) of the ceiling panel 23 with the front end of the floor panel 24, and a back wall 26 opposite the front wall 25 and connecting the back end (other end) of the ceiling panel 23 with the back end of the floor panel 24. The front wall 25 and back wall 26 are mutually parallel and perpendicular to the ceiling panel 23 and floor panel 24. The front wall 25, back wall 26, ceiling panel 23, and floor panel 24 all have the same width, and form a rectangular frame 27. A handle 26*a* is disposed close to the outside of the back wall 26. The handle 26*a* extends vertically along the back wall 26.

The case 22 also has a side wall 28 that closes one open side of the frame 27 formed by the ceiling panel 23, floor panel 24, front wall 25, and back wall 26, and a translucent film 29 closing the other open side of the frame 27. The case 22 is a thin, flat construction, and the width of the ceiling panel 23, floor panel 24, front wall 25, and back wall 26 is less than the vertical height of and the length between the front wall 25 and the opposing back wall 26.

A positioning part 31, a stop 32, the waste ink input port 20, and an air vent 33 are disposed to the case 22.

The positioning part 31 is disposed at the top end of the front wall 25. The positioning part 31 has a positioning slot 34 that is perpendicular to the front wall 25 and recessed to the back.

The stop 32 is disposed at the bottom end of the front wall 25. The stop 32 has a locking slot 35 that is perpendicular to the front wall 25 and recessed to the back.

A positioning tab (not shown in the figure) that can fit into the positioning slot 34, and a locking tab (not shown in the figure) that can slide into the locking slot 35, are also disposed to the waste ink tank compartment 12. When the waste ink tank 13 is installed to the waste ink tank compartment 12, the positioning tab fits into the positioning slot 34, and the locking tab slides into the locking slot 35. As a result, the waste ink tank 13 is installed to the waste ink tank compartment 12 in a specific posture and a specific position.

The waste ink input port 20 is formed at a position near the positioning part 31 at the top end part of the front wall 25. The waste ink input port 20 has a waste ink inlet 36 through which a waste ink injection needle 17*a* (FIG. 2) disposed to the downstream end of the waste ink recovery path 17 can pass, and a needle support 37 that supports the waste ink injection needle 17*a* passing through the waste ink inlet 36.

As shown in FIG. 4, the needle support 37 has a top part 38 that projects to the back from the front wall 25, a back wall 39 that extends down from the back end of the top part 38, and a bottom part 40 that extends to the front from the bottom end of the back wall 39 and connects to the front wall 25. The waste ink inlet 36 includes an outside waste ink inlet 36*a* formed in the front wall 25, and an inside waste ink inlet 36*b* formed coaxially to the outside waste ink inlet 36*a* in the back wall 39 of the needle support 37. When the waste ink tank 13 is installed to the waste ink tank compartment 12, the waste ink injection needle 17*a* passes through the waste ink inlet 36 (through the outside waste ink inlet 36*a* and inside waste ink inlet 36*b*) to the sponge 21 inside the case 22, and is supported by the needle support 37. As a result, the head cap 14 and the waste ink tank 13 communicate through the waste ink recovery path 17.

The air vent 33 is a round hole formed in the top part of the film 29 near the back wall 26. The air vent 33 is positioned slightly higher than the waste ink input port 20. A columnar plug 45 protrudes to the film 29 side from the side wall 28 at a position opposite the air vent 33. The height (length) of the plug 45 corresponds to the width of the ceiling panel 23 and back wall 26, and the edges of the air vent 33 in the film 29 contact the round distal end face 45*a* of the plug 45. A columnar positioning pin 46 that can enter the air vent 33 is disposed to the center of the round end face 45*a* of the plug 45. The end of the positioning pin 46 is exposed from the air vent 33 to the outside of the case 22.

The case 22 also has two ribs 51, 52 that partition the inside of the case 22 between the waste ink input port 20 and the air vent 33. The ribs 51, 52 extend down from the ceiling panel 23 in a straight line parallel to the front wall 25. The ribs 51, 52 are also contiguous to the side wall 28. The top end of each rib 51, 52 has a rectangular notch formed from the opposite side as the side wall 28. Each rib 51, 52 has a branched support part 53 that splits down to the front and back at the bottom end of the rib, and a curved connector 54 that extends in the front-back direction and joins the bottom ends of the branched support part 53. More specifically, the branched support part 53 has a front support 55 that extends down toward the front, a back support 56 that extends down toward the back, and the bottom end of the front support 55 and the bottom end of the back support 56 are connected by the curved connector 54 that protrudes down.

As shown in FIG. 4, the bottom ends 51*a*, 52*a* of the ribs 51, 52 are positioned closer to the floor panel 24 than the ceiling panel 23. Of the two ribs 51, 52, the bottom end 52*a* of the rear rib 52 is lower than the bottom end 51*a* of the front rib 51.

First gap L1 between the front rib 51 and front wall 25 is greater than both the second gap L2 between the front rib 51 and the back rib 52, and the third gap L3 between the back rib 52 and the back wall 26. The second gap L2 is greater than the third gap L3. The third gap L3 is therefore smaller than both the first gap L1 and the second gap L2.

The case 22 also has two flat front reinforcement ribs 61 that protrude from the front wall 25 to the back and continue to the side wall 28, and two flat bottom reinforcement ribs 62 that protrude up from the floor panel 24 and continue to the side wall 28.

The two front reinforcement ribs 61 are disposed at equal intervals between the waste ink input port 20 and the stop 32. The length the front reinforcement ribs 61 protrude from the front wall 25 is shorter than the width of the front wall 25.

The two bottom reinforcement ribs 62 are respectively disposed in the front-back direction between the front rib 51 and the back rib 52, and between the back rib 52 and the back wall 26. The length the bottom reinforcement ribs 62 protrude from the floor panel 24 is shorter than the width of the floor panel 24.

The parts of the case 22 other than the film 29 are monolithically molded. The film 29 is a high rigidity aluminum film, and is affixed by welding to the floor panel 24, front wall 25, back wall 26, front rib 51, and back rib 52 on the opposite side as the side wall 28. The notch formed at the top end of the front rib 51 thus forms a front passage 65 connecting a front waste ink storage space S1 between the front rib 51 and front wall 25 to a middle waste ink storage space S2 between the front rib 51 and back rib 52. The notch formed at the top end of the back rib 52 similarly forms a back passage 66 connecting the middle waste ink storage space S2 to aback waste ink storage space S3 between the back rib 52 and the back wall 26.

Storing Waste Ink in the Waste Ink Tank

Waste ink pumped by the feed pump 18 through the waste ink inlet 36 into the case 22 permeates down through the sponge held in the front waste ink storage space S1 due to gravity as shown by arrow A in FIG. 4. The waste ink then moves through the sponge held in the space between the bottom end 51*a* of the front rib 51 and the floor panel 24 toward the back from the front rib 51. The waste ink can therefore permeate and be stored by all of the sponge 21 filling the case 22.

Because the bottom end 52*a* of the back rib 52 is lower than the bottom end 51*a* of the front rib 51, the waste ink absorbed by the sponge 21 first permeates the part of the sponge held in the middle waste ink storage space S2 between the front rib 51 and back rib 52 as indicated by arrow B. The waste ink then permeates the part of the sponge held in the back waste ink storage space S3 on the back side of the back rib 52 as indicated by arrow C. The time until the waste ink permeates to near the air vent 33 can therefore be delayed.

When the pressure in the front waste ink storage space S1 and middle waste ink storage space S2 rises by the introduction of waste ink to the case 22 in this embodiment, air inside the case 22 moves into the back waste ink storage space S3 through the gap between the bottom ends 51*a*, 52*a* of the ribs 51, 52 and the floor panel 24, and the front passage 65 disposed to the front rib 51 and the back passage 66 disposed to the back rib 52, and the pressure inside the back waste ink storage space S3 rises. This causes the back part of the film 29 forming the back waste ink storage space S3 to expand to the outside, and the open edges of the air vent 33 to separate from the end face 45*a* of the plug 45. As a result, air inside the case 22 is vented to the outside from the air vent 33. Air can therefore be appropriately discharged from the air vent 33 as waste ink is introduced to the case 22, and the air inside the case 22 can be gradually replaced with waste ink. Waste ink introduced to the case 22 through the waste ink inlet 36 can therefore be prevented from leaking to the outside from the outside waste ink inlet 36*a*.

When waste ink is stored in the case 22 to the point where the space between the bottom ends 51*a*, 52*a* of the ribs 51, 52 and the floor panel 24 is filled, air inside the case 22 can no longer move into the back waste ink storage space S3 through the space between the bottom ends 51*a*, 52*a* of the ribs 51, 52 and the floor panel 24. However, because a front passage 65 and back passage 66 are respectively disposed to the front rib 51 and the back rib 52, an air path is always open from the front waste ink storage space S1 and middle waste ink storage space S2 to the back waste ink storage space S3 where the air vent 33 is located inside the case 22 as indicated by the dotted line and arrow D in FIG. 4. Air inside the case 22 can therefore be desirably discharged from the air vent 33 and air inside the case 22 can be continuously replaced with waste ink even when space between the bottom ends 51*a*, 52*a* of the ribs 51, 52 and the floor panel 24 is filled with waste ink. Waste ink introduced to the case 22 through the waste ink inlet 36 can therefore be prevented from leaking to the outside from the outside waste ink inlet 36*a*.

Effect of the Disclosure

Because the case 22 in this example is thin and flat, the space occupied by the waste ink tank 13 can be suppressed when the waste ink tank 13 is installed in the printer case 3.

Furthermore, because two ribs 51, 52 are disposed in the case 22, the strength of the case 22 can be assured even when the case 22 is thin and flat.

Yet further, because an air passage 65, 66 is formed in each rib 51, 52, and the top end of each rib 51, 52 connects to the ceiling panel 23, the strength of the case 22 can be maintained even when an air passage 65, 66 is formed in each rib 51, 52.

Yet further, because the front rib 51 and back rib 52 are straight and the shape of the ribs 51, 52 is simple, the sponge 21 can be easily held inside the case 22. A large sponge 21 can also be stored because a large waste ink storage space S1, S2, S3 can be created inside the case 22.

Next, the part of the sponge in the front waste ink storage space S1 on the waste ink input port 20 side of the front rib 51 is kept wet by the waste ink introduced from the waste ink input port 20. As a result, permeation to the sponge 21 is promoted even when the waste ink is pigment ink.

Furthermore, because the open side of the frame 27 formed by the side wall 28, ceiling panel 23, floor panel 24, front wall 25, and back wall 26 is closed by welding a film 29 thereto in this embodiment, the case 22 can easily be made fluid tight. In addition, because the ribs 51, 52 have a branched support part 53 that splits into two parts extending down toward the front and back at the bottom end, the stress on the film 29 is dispersed and the welded parts of the film 29 welded to the ribs 51, 52 can be prevented from tearing when the sponge stored in space between the bottom ends 51*a*, 52*a* of the ribs 51, 52 and the floor panel 24 holds a large amount of waste ink and the film 29 is stretched.

Yet further, because the third gap L3 between the back rib 52 and the back wall 26 is smaller than the first gap L1 between the front wall 25 and the front rib 51 and the second gap L2 between the front rib 51 and the back rib 52, the strength of the back end of the case 22 near the handle 26*a* can be improved. The case 22 can therefore be prevented from deforming when the case 22 is held by the back end and the waste ink tank 13 is installed and removed from the printer case 3 using the handle 26*a*.

Variations

Figure 5A:
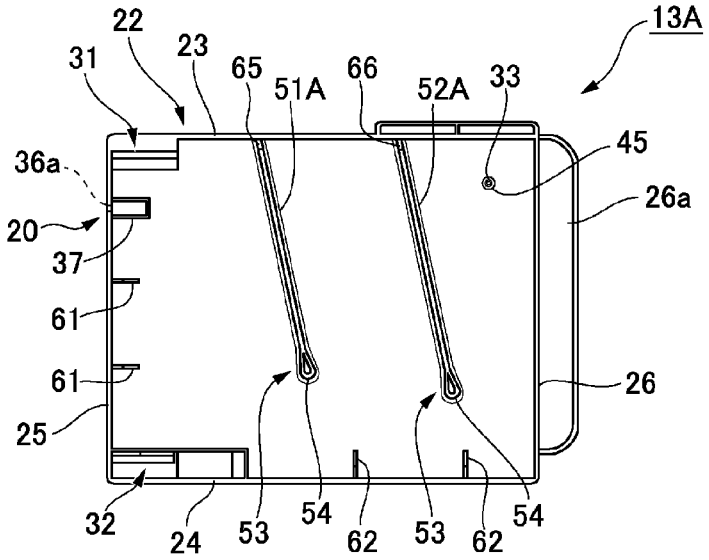
FIG. 5A describes an example of a waste ink tank according to a first variation.
Figure 5B:
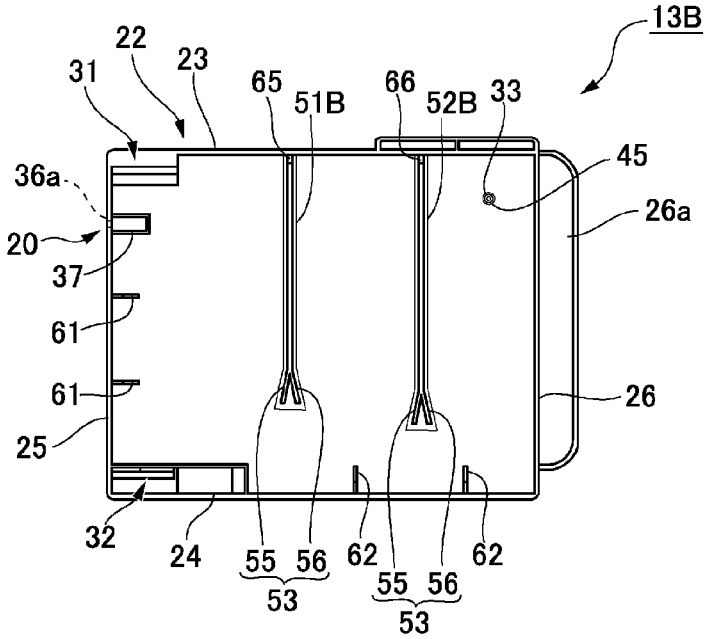
FIG. 5B describes an example of a waste ink tank according to a second variation.

FIGS. 5A and 5B show other examples of the waste ink tank 13 in which the shape of the ribs is changed. Waste ink tanks 13A and 13B according to these variations as described below are constructed similarly to the waste ink tank 13 described above, like parts are therefore identified by the same reference numerals, and further description thereof is omitted.

As shown in FIG. 5A, the ribs 51A, 52A that partition the inside of the case 22 in the waste ink tank 13A according to the first variation slope down towards the back wall 26. As shown in FIG. 5B, the connectors 54 that connect the bottom ends of the branched support parts 53 of the ribs 51B, 52B are omitted in the waste ink tank 13B according to the second variation.

As described above, the strength of the case 22 can also be improved in these waste ink tanks without interfering with introducing waste ink to the case 22 and absorption of the introduced waste ink by the sponge 21.

In addition, stress on the film 29 is dispersed and the welded parts of the film 29 welded to the ribs 51A, 52A, 51B, 51B can be prevented from tearing when the sponge stored in space between the ribs 51A, 52A, 51B, 51B and the floor panel 24 holds a large amount of waste ink and the film 29 is stretched.

The air passages 65, 66 in the above examples are formed by omitting a portion of the top end of each rib on the opposite side as the side wall 28, but the air passages could be formed by omitting a portion of the top end in the middle of each rib from the ceiling panel 23 side. Further alternatively, the air passages could be formed by omitting a portion of the top end of each rib near the side wall 28.

The ribs extend from the ceiling panel 23 in the foregoing embodiments, but the ribs could be formed starting from a position slightly below the ceiling panel 23 without connecting to the ceiling panel 23. In this configuration, the gap between the top end of each rib and the ceiling panel 23 forms the air passage.

Further alternatively, each rib could be a flat member of a constant thickness. More specifically, the ribs can be formed without the branched support part 53 and connector 54.

The foregoing examples are described having two ribs extending from the ceiling panel 23 as ribs that partition the inside of the case 22, but the disclosure is not so limited and there could be one rib or three or more ribs. Because an air passage to the air vent 33 inside the case 22 can be created regardless of the number of ribs by forming a passage through the top end part of each rib, the strength of the case 22 can be improved without interfering with introducing waste ink to the case 22 and the absorption of the introduced waste ink by the sponge 21.

Yet further alternatively, the ribs that extend down from the ceiling panel 23 and partition the inside of the case 22 could curve or bend between the top and bottom ends.

The disclosure being thus described, it will be obvious that it may be varied in many ways. Such variations are not to be regarded as a departure from the spirit and scope of the disclosure, and all such modifications as would be obvious to one skilled in the art are intended to be included within the scope of the following claims.

What is claimed is:

1. A waste ink tank, comprising:

a case having a waste ink inlet and an air vent that are disposed at the top part of the case;

a waste ink storage space that stores waste ink introduced to the case from the waste ink inlet;

a sponge that absorbs the waste ink inside the case;

a rib that partitions the waste ink storage space inside the case; and an air passage formed at the top part of the rib and connecting the plural waste ink storage spaces that are separated by the rib, wherein:

the case has a ceiling panel, a floor panel, a front panel that extends vertically and connects the end part on one side of the ceiling panel with the end part on the same one side of the floor panel, a back panel that is opposite the front panel and connects the end part on the other side of the ceiling panel with the end part on the other side of the floor panel, and has the waste ink inlet formed in the front panel;

the rib includes two ribs extending from the ceiling panel of the case toward the floor panel opposite the ceiling panel; and the bottom end of the rear rib, which of the two ribs is the rib on the air vent side, is positioned lower than the bottom end of the front rib, which is the rib on the waste ink inlet side.

2. The waste ink tank described in claim 1, wherein:

the front rib and the rear rib extend in a straight line.

3. The waste ink tank described in claim 1, wherein:

the front panel is parallel to the back panel and perpendicular to the ceiling panel;

the front rib and rear rib are both parallel to the front panel and perpendicular to the ceiling panel; and the space between the rear rib and the back panel is narrower than the space between the front panel and the front rib and the space between the front rib and the rear rib.

4. The waste ink tank described in claim 3, wherein:

the case has a side panel covering the opening on one side of a frame formed by the ceiling panel, floor panel, front panel, and back panel, and a film covering the opening on the other side of the frame;

the ceiling panel, floor panel, front panel, back panel, side panel, and rib are monolithically molded from plastic;

the air passage is disposed as a notch in the top end of the rib on the opposite side as the side panel; and the film is welded to the ceiling panel, floor panel, front panel, back panel, and rib.

5. The waste ink tank described in claim 4, wherein:

the air vent is formed in the top part of the film on the side closer to the back panel than the front panel.

6. The waste ink tank described in claim 4, wherein:

a valve that opens only when waste ink is introduced is disposed to the air vent;

the valve has a plug member that protrudes from the side panel so that the film in which the air vent is formed and the distal end of the plug member contact around the periphery of the air vent in the film and the plug member closes the air vent; and the air vent opens by the periphery of the air vent in the film deformed by the pressure of introducing waste ink from the waste ink inlet separating from the distal end of the plug member.

7. The waste ink tank described in claim 6, wherein:

a protrusion is disposed to the distal end of the plug member and passes through the air vent to position the distal end to the air vent.

8. The waste ink tank described in claim 4, wherein:

a branched support part that separates into two branches descending down to the front and back is disposed to the bottom end of the rib.

9. The waste ink tank described in claim 1, wherein:

the case has a flat rectangular shape, and the width of the ceiling panel, floor panel, front panel, and back panel is less than the length and the height of the case.

10. An inkjet printer comprising:

an inkjet head;

a head cap that can oppose the inkjet head;

a waste ink tank described in claim 1; and a waste ink recovery path that carries ink ejected from the inkjet head into the head cap to the waste ink inlet of the waste ink tank as waste ink.

* * * * *